US005626540A

United States Patent [19]

Hall

[11] Patent Number: 5,626,540

[45] Date of Patent: May 6, 1997

[54] AMBULATORY TRACTION ASSEMBLY

[76] Inventor: Raymond F. Hall, 10780 Santa Monica Blvd., Suite 440, Los Angeles, Calif. 90025

[21] Appl. No.: 271,363

[22] Filed: Jul. 6, 1994

[51] Int. Cl.[6] ..... A61H 3/00

[52] U.S. Cl. ..... 482/69; 482/908; 606/241

[58] Field of Search ..... 482/23, 43, 51, 482/54, 69, 904, 908; 602/23, 34, 36; 606/241; 5/81.1, 83.1, 84.1, 85.1; 297/275, DIG. 10

[56] References Cited

U.S. PATENT DOCUMENTS

| | | | |
|---|---|---|---|
| 219,439 | 9/1879 | Blend . | |
| 2,109,188 | 2/1938 | Bajanova . | |
| 2,719,568 | 10/1955 | Webb . | |
| 2,812,010 | 11/1957 | Abdallah . | |
| 2,892,455 | 6/1959 | Hutton . | |
| 3,379,439 | 4/1968 | Sorenson et al. | 482/43 |
| 3,780,663 | 12/1973 | Pettit . | |
| 4,114,611 | 9/1978 | Lyle et al. | 606/241 |
| 4,340,216 | 7/1982 | Murphy | 482/43 |
| 4,449,716 | 5/1984 | Goldy et al. | 482/43 |
| 4,534,341 | 8/1985 | Bart et al. | 606/241 |
| 4,569,340 | 2/1986 | Burton . | |
| 4,655,447 | 4/1987 | Dubrinsky et al. . | |
| 4,687,196 | 8/1987 | Dubrinsky et al. . | |
| 4,880,230 | 11/1989 | Cook . | |
| 4,911,426 | 3/1990 | Scales . | |
| 4,981,307 | 1/1991 | Walsh | 482/31 |
| 5,050,590 | 9/1991 | Futakami . | |
| 5,129,881 | 7/1992 | Pope . | |
| 5,135,458 | 8/1992 | Huang . | |
| 5,174,590 | 12/1992 | Kerley et al. . | |
| 5,181,905 | 1/1993 | Flam . | |
| 5,273,502 | 12/1993 | Kelsey et al. | 482/69 |
| 5,466,204 | 11/1995 | Nearing . | |

FOREIGN PATENT DOCUMENTS

| | | | |
|---|---|---|---|
| 2252108 | 6/1975 | France | 482/69 |
| 622473 | 9/1978 | U.S.S.R. | 482/43 |
| 1496809 | 7/1989 | U.S.S.R. | 482/54 |

OTHER PUBLICATIONS

Advertisement entitled "PneuWeight", undated but believed to be dated prior to Jul. 6, 1994.

Instruction sheet for "TX" traction units Tx–7, Tx–8, dated Mar. 1991.

*Primary Examiner*—Richard J. Apley
*Assistant Examiner*—Jeanne M. Clark
*Attorney, Agent, or Firm*—Loeb & Loeb LLP

[57] ABSTRACT

An ambulatory traction system which is designed to provide decompressional forces to the lumbosacral spine, lower body and related connective tissues at varying speeds from static to ambulation speeds up to 12 MPH. The ambulatory traction system has an overhead support assembly for horizontal linear displacement and a novel harness assembly suspended from the overhead support assembly to support and suspend the patient's body. A variable ambulation speed system is provided beneath the harness assembly which allows the patient, while being suspended by the harness assembly, to stand, walk or run thereon.

20 Claims, 6 Drawing Sheets

AMBULATORY TRACTION ASSEMBLY

BACKGROUND OF THE INVENTION

This application relates to an invention disclosed in Disclosure Document No. 333287, filed Apr. 23, 1993.

1. Field of the Invention

The present invention relates to a traction system, and more particularly to a traction system for rehabilitative, diagnostic, therapeutic and training programs.

2. Description of Related Art

When a patient is suffering from one of various spinal injuries and diseases, such as disc compressional syndromes, facet syndromes, compression fractures, arthritides, contusional injuries, scoliosis, strains and sprains, etc., a traction system may be required to alleviate spinal stress and load to facilitate rehabilitation and hasten healing and recovery.

Various traction systems have been proposed which include a harness to suspend and pull particular parts of the patient's body. However, these traction systems generally do not provide sufficient rehabilitative and therapeutic results for a patient particularly suffering from these spinal injuries and diseases. For example, the ambulatory systems described in U.S. Pat. No. 2,812,010 to Abdallah or U.S. Pat. No. 3,780,663 to Pettit include a harness suspended from an overhead sliding track in which the patient may walk upright while suspended by the harness. However, such harness and support assemblies typically have limited adjustability and can interfere with proper breathing.

SUMMARY OF THE INVENTION

It is an object of the present invention to provide a traction system particularly designed to provide rehabilitative and therapeutic treatments to patients suffering from spinal injuries and diseases in which healing response as well as rehabilitative and training response are maximized.

It is another object of the present invention to provide a traction system which alleviates compressional/load stress in/to all parts of the human body to facilitate decreasing somatic adaptive responses, such as muscle inflammation and muscle spasms, reducing adhesions such as intraarticular, juxtarticular, myofascial, myotendinous and tenoperiosteal adhesions, increasing connective tissue strength and circulation, and realigning connective tissue fibers in a "normal" manner.

It is still another object of the present invention to provide a traction system which facilitates, maintains and reeducates the body's neurological responses to movement through but not limited to the mechanoreceptive, proprioceptive, and cross-extensor reflex pathways, alpha motor pathways, and through stimulating and facilitating cerebellar and cerebral neurons to enhance normal and or optimal ambulation movement patterns.

It is a further object of the present invention to provide a traction system in combination with a variable ambulation speed system which provides decompressional forces to the lumbosacral spine, lower extremities and related connective tissues at varying speeds from static to ambulation speed.

It is still a further object of the present invention to provide a traction system in combination with a treadmill and a harness assembly for suspending a patient which facilitates the adjustment of suspension or pull of the harness assembly, inclination and speed of the treadmill, and tension (pull) angle (vector) of the harness assembly.

It is yet another object of the present invention to provide a traction system with unique harness and pulley designs which provide uniform symmetrical pull of the harness.

These and other objects and advantages are achieved in an ambulatory traction system which comprises, in accordance with one embodiment of the present invention, a horizontal beam member, an overhead support assembly for linear displacement along the horizontal beam member and a harness assembly suspended from the overhead support assembly to support and suspend the patient's body. The harness assembly is designed to provide a stable support to the upper body of the patient as well as to facilitate breathing of the patient while the patient is suspended by the harness assembly. To maximize healing response of the body as well as rehabilitative and training response, a variable ambulation speed system is provided beneath the harness assembly which allows the patient, while being suspended by the harness assembly, to walk thereon. The overhead support assembly provides a translational linear displacement of the harness assembly in parallel with the horizontal beam member. As a result, the patient's upper body is stabilized in the upright position while walking or running on the variable ambulation speed system.

DETAILED DESCRIPTION OF PREFERRED EMBODIMENTS

Figure 1:
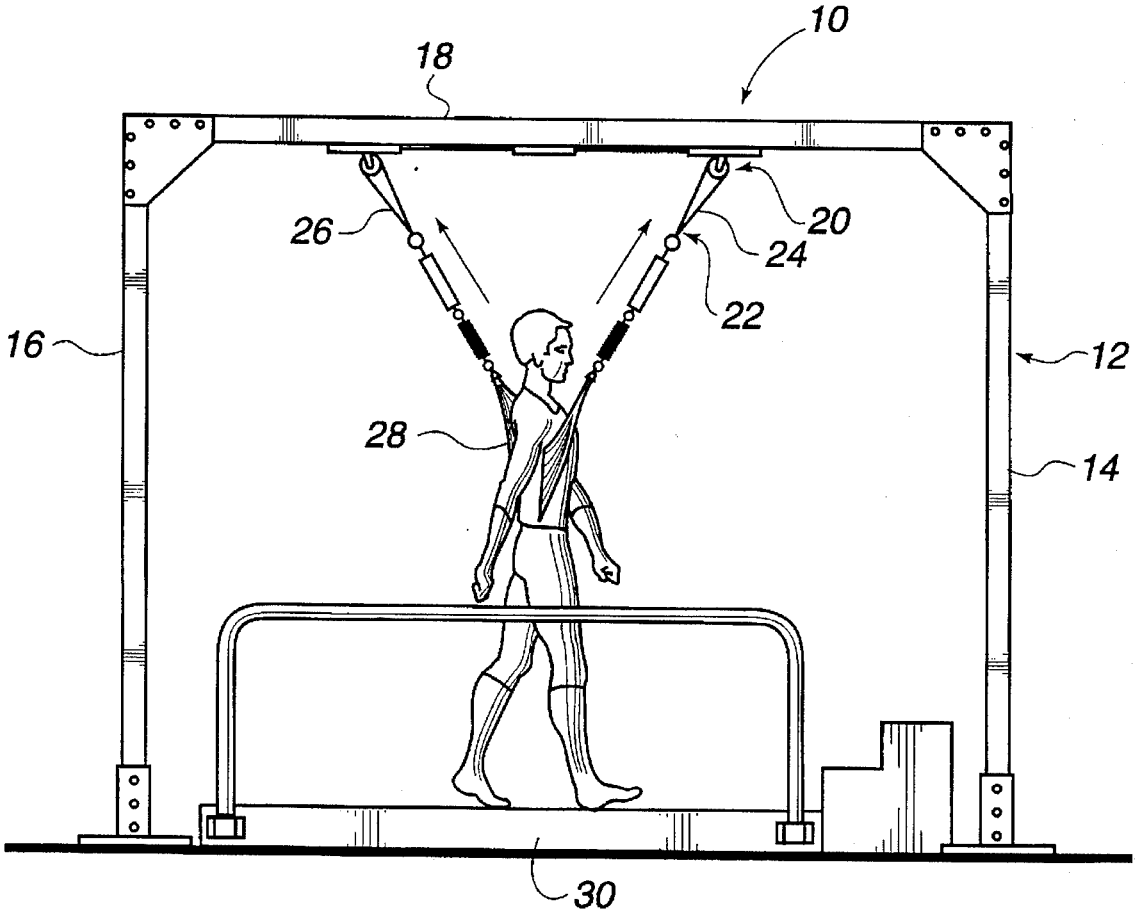
FIG. 1 is a schematic side view illustrating an ambulatory traction unit in accordance with a preferred embodiment of the present invention and showing the manner in which a patient is suspended thereby in an upright walking position.
Figure 2:
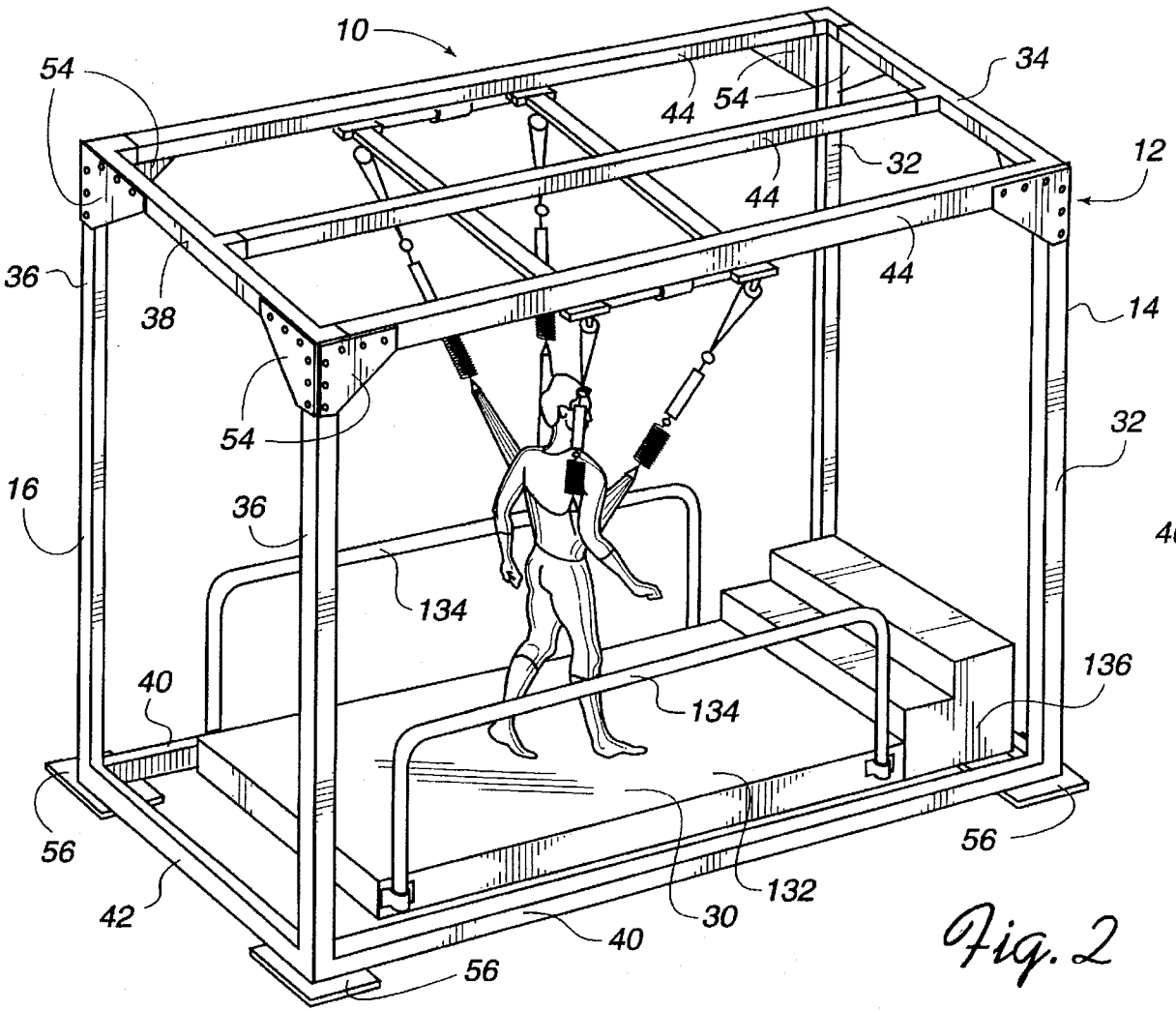
FIG. 2 is a perspective view of the ambulatory traction unit shown in FIG. 1.

An ambulatory traction unit in accordance with a preferred embodiment of the present invention is indicated generally at 10 as illustrated in FIGS. 1–2. The ambulatory traction unit 10 includes a frame structure 12. The frame structure includes a horizontally extending overhead frame assembly 18 which is supported by a pair of front and rear vertical frame assemblies 14 and 16. An overhead support assembly 20 slidably engages the overhead frame assembly 18 for substantially linear horizontal displacement between the front and rear vertical frame assemblies 14 and 16. A harness assembly 22 includes a front strap assembly 24 and a rear strap assembly 26, both attached at respective upper ends thereof to the overhead support assembly 20. Connected to the lower ends of the front and rear strap assemblies 22 and 24 is a harness main body 28 which is releasably attached to the body of the patient. A variable ambulation speed system 30 is positioned below the harness assembly 22 to allow the patient to walk thereon while the patient is receiving treatments. The front strap assembly 24 and the rear strap assembly 26 are downwardly and diagonally angled with respect to each other (as best seen in FIG. 1) so that the front and rear strap assemblies 24 and 26 generally define two sides of an inverted triangle when the patient is supported and suspended by the harness assembly 22 in an upright position. As a result of the triangular configuration defined by the harness strap assemblies 24 and 26, the patient's upper body is substantially stably suspended while walking on the variable ambulation speed system 30.

The frame structure 12 may be made of any one of a variety of suitable materials, such as, aluminum, iron, reinforced glassfiber, plastic or a combination thereof. In the illustrated embodiment, the front vertical frame assembly 14 of the frame structure 12 includes a pair of vertically extending frame members 32 and a laterally extending upper frame member 34 spanning between the vertical frame members 32 adjacent the top end portions thereof. The rear vertical frame assembly 16 also includes a pair of vertically extending frame members 36 and a laterally extending upper frame member 38 spanning between the vertical frame members 36. The vertical frame members 32 and 36 may be connected with each other at their respective lower end portions by two longitudinally extending lower frame members 40 and two laterally extending lower frame members 42.

The overhead frame assembly 18 of the frame structure 12 preferably includes three longitudinal overhead frame members 44 which extend generally in parallel with each other between the front vertical frame assembly 14 and the rear vertical frame assembly 16. Two of the longitudinal overhead frame members 44 are connected to the front and rear vertical frame assemblies 14 and 16 adjacent the vertical frame members 32 and 36. The remaining one of the longitudinal overhead frame members 44 may be connected to the intermediate portions of the laterally extending upper frame members 34 and 38. It should be appreciated that the number of the longitudinal overhead frame members may be more or less depending on the particular requirements. For example, a single longitudinal overhead frame member may be provided to allow horizontal and linear displacement of the overhead support assembly 20 along that single overhead frame member.

Figure 3:
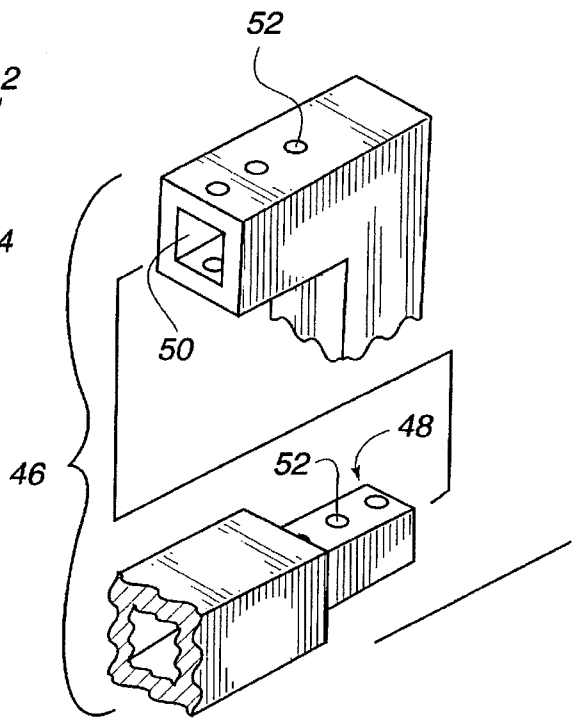
FIG. 3 is an enlarged sectional view illustrating a splice joint between two members of the frame structure shown in FIG. 2.

The frame members may be connected to each other in any suitable manner. In one embodiment, the frame members may, at least partially, be joined with each other by spline connections. FIG. 3 shows a typical spline connection 46 which is formed by a male protrusion 48 on one frame member and a female recess 50 on another frame member. After the two members are coupled with each other through the spline connection 46, screws or other suitable fastening devices may be used to fasten the two frame members together. In this embodiment, screw holes 52 are provided in one frame member having the female recess 50 and in the associated male protrusion 48 to receive screws (not shown). To provide greater structural rigidity to the frame structure 12, corner bracing webs 54 or the like may be provided. In addition, base plates 56 may be attached to the bottom of the frame structure 12, preferably at four bottom corners of the frame structure 12, to provide greater stability to the frame structure 12.

Figure 4:
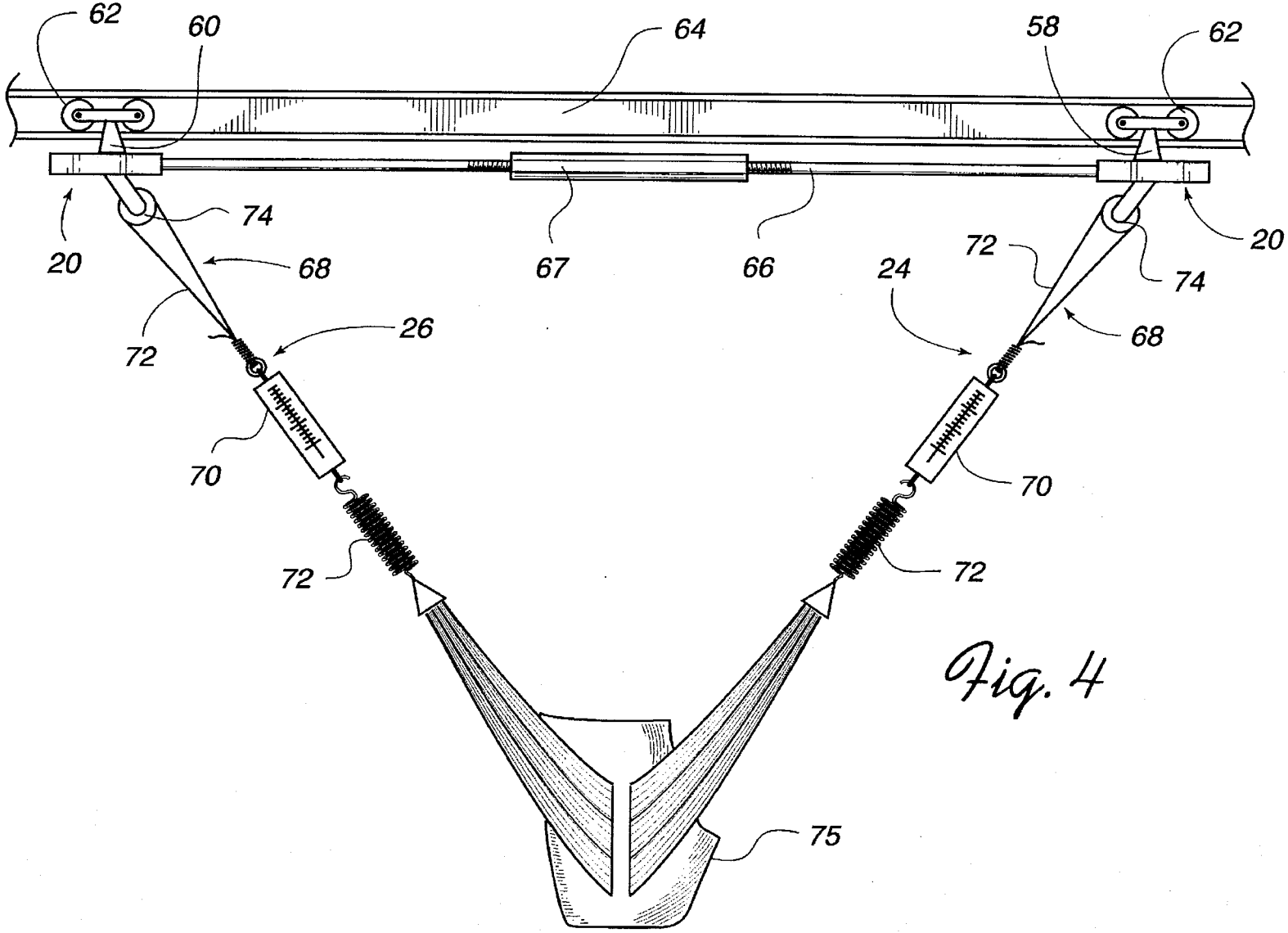
FIG. 4 is an enlarged side view illustrating an overhead support assembly and a harness assembly of the ambulatory traction unit of FIG. 1.

FIG. 4 shows in detail the overhead support assembly 20 and the harness assembly 22. The overhead support assembly 20 includes a plurality of front sliding elements 58 and a plurality of rear sliding elements 60. As best seen in FIG. 2, the overhead assembly 20 of this embodiment has two front sliding elements 58 and two rear sliding elements 60, both of which are mounted respectively on the two spaced longitudinal overhead frame members 44. Each of the front and rear sliding elements 58 and 60 has a truck and wheel assembly 62 which is guided along a guide track 64 of the overhead frame members 44. It should be appreciated that each of the longitudinal overhead frame members may be formed by a beam member having an appropriate track for horizontally guiding the truck and wheel assembly 62. Alternatively, an independent guide track may be attached to each of the longitudinal overhead frame members which carries the truck and wheel assembly 62. It should be appreciated that sliding elements other than the truck and wheel assemblies such as sliding pads or bearings may be used.

A spacer bar assembly 66 is provided between the front sliding elements 58 and the rear sliding elements 60 to maintain a predetermined separation therebetween. The spacer bar assembly 66 may preferably include a length adjusting mechanism 67 for changing the length of the spacer bar assembly 66 and therefore the separation between the front sliding elements 58 and the rear sliding elements 60. As described below in greater detail, the front and the rear strap assemblies 24 and 26 of the harness assembly 22 are connected to the respective front and rear sliding elements 58 and 60. Accordingly, the separation between the front and the rear strap assemblies 24 and 26 adjacent the front and rear sliding assemblies can be changed by varying the length of the spacer bar assembly 66.

As shown in FIG. 4, each of the front and rear strap assemblies 24 and 26 of the harness assembly 22 includes a cleated pulley assembly 68 for length adjustment, a tension scale 70 for measurement and indication of the tension along the strap assembly and a tension spring 72 for maintaining substantially constant tension along the strap assembly. The cleated pulley assembly 68 has at its upper end a pulley 74 coupled to the associated sliding element and a rope 72 cleated at its lower end which is connected to the upper end of the tension scale 70. The harness assembly 22 has a main harness body 75 which is connected to the front strap assembly 24 and the rear strap assembly 26. In this embodiment, the harness main body 75 is connected to the lower ends of the tension springs 72 of the front and rear strap assemblies 24 and 26. In one aspect of the present invention, the front and rear sliding elements 58 and 60 are separated by the spacer bar assembly 66 to an extent that the upper ends of the front and rear strap assemblies 24 and 26 are separated from each other substantially greater than the longitudinal separation at the lower ends thereof which are connected to the harness main body 75. As a result, the front strap assembly 24 and the rear strap assembly 26 are downwardly and diagonally angled with each other so that the harness main body 75 is suspended between the front and rear strap assemblies 24 and 26 which generally define two sides of an inverted triangle. Furthermore, the two longitudinal overhead frame members 44 carrying the two front sliding elements 58 and the two rear sliding elements 60 may be laterally separated substantially wider than the lateral separation between the lower ends of the two front strap assemblies and the two rear strap assemblies respectively as shown in FIG. 2. As a result, the two front strap assemblies and the two rear strap assemblies are downwardly and diagonally angled with each other so that the harness main body 75 is suspended at the lower ends of the four strap assemblies which generally define four sides of an inverted pyramid configuration.

Figure 5A:
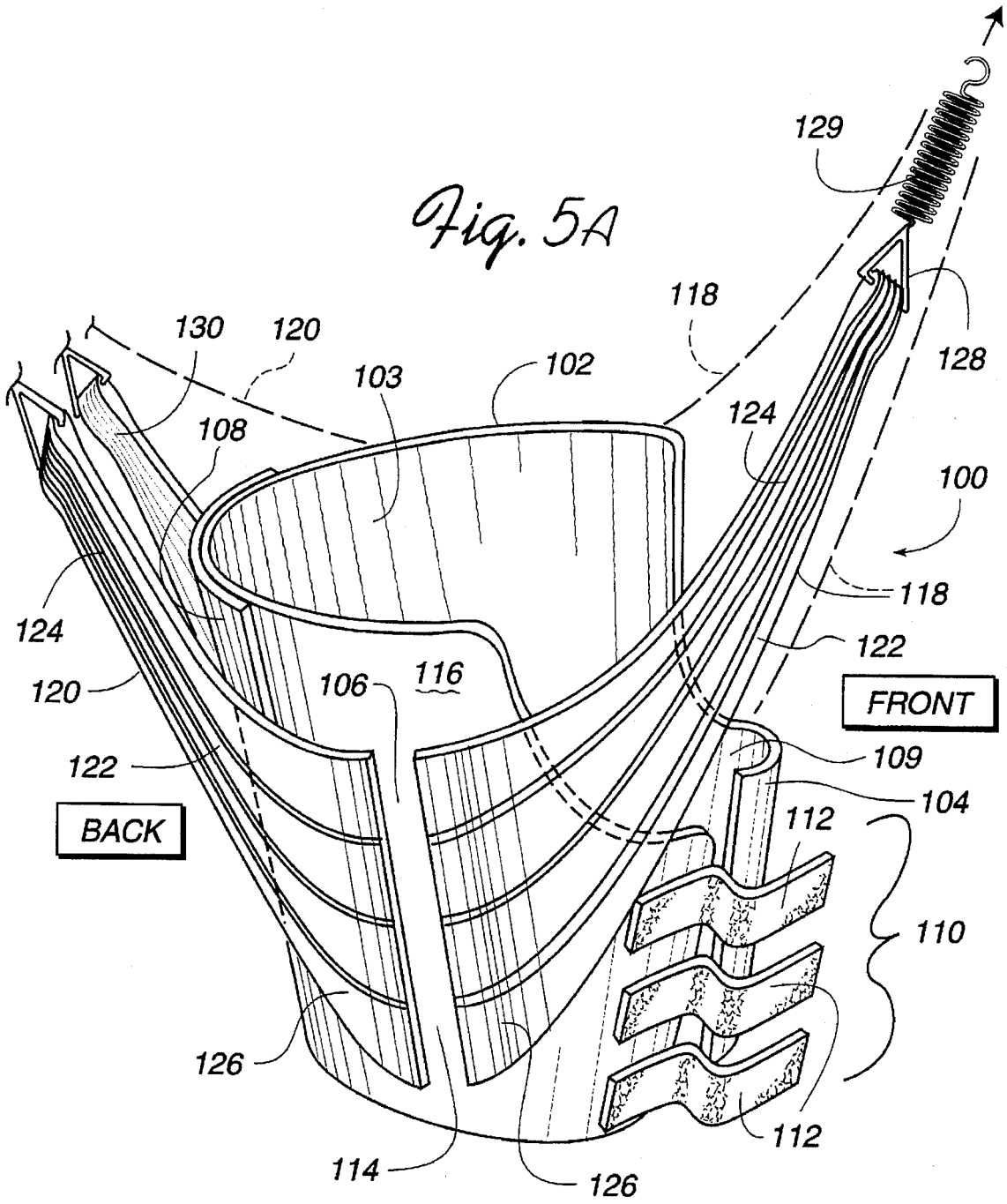
FIG. 5A is a perspective view of a corset of the harness assembly in accordance with one embodiment of the present invention.
Figure 5B:
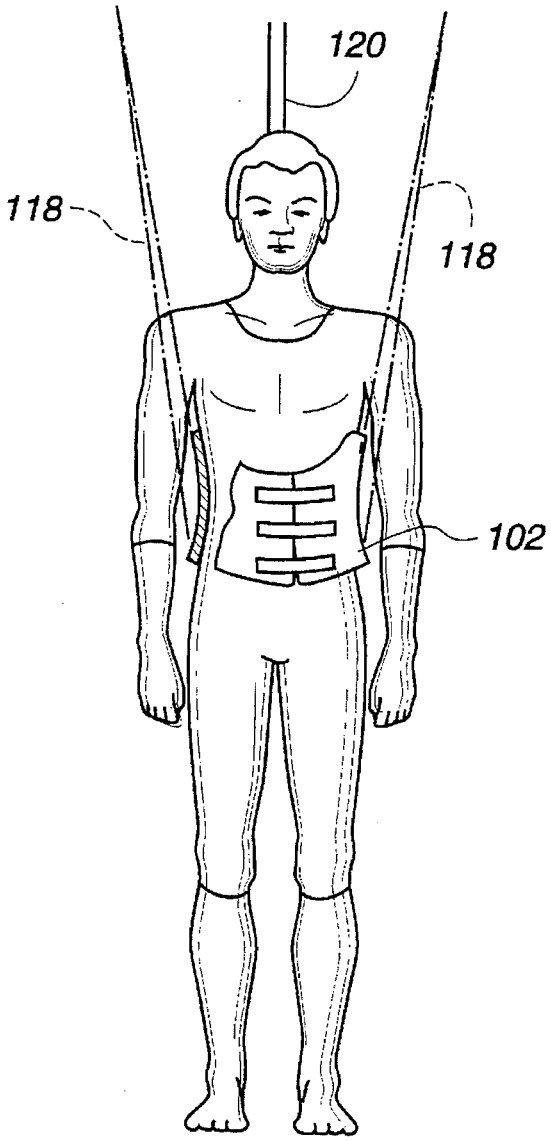
FIG. 5B is a front view showing the manner in which a patient is suspended by the corset of the harness assembly of FIG. 5A with the corset being partially broken.

FIG. 5 shows one embodiment of the harness assembly indicated generally at 100. The harness assembly 100 includes a corset-like main body 102 which is designed to provide under-rib cage lift when the patient is suspended by the harness assembly 100. The corset main body 102 may be provided with a high friction lining 103 on its inside surface and is shaped to generally encircle the abdomen, sides and back of the patient. The corset main body 102 may be made of any one of a variety of materials, such as for example, canvas, leather, plastic material or a combination thereof. The corset main body 102 has an open front section 104, side sections 106, and a rear section 108. The open front section 104 is provided with a generally U-shaped cut 109 to substantially avoid contact with the frontal chest portion of the patient. It is found that the U-shaped cut 109 substantially facilitates breathing of the patient when the patient, relatively tightly wrapped within the corset main body 102, is suspended by the harness assembly 100. The open front section 104 includes a fastening device 110 which is provided below the U-shaped cut 109. Preferably, the fastening device 110 is formed by VELCRO straps 112 for repeated opening and closing of the corset main body 102 and for ready adjustment of the peripheral size of the corset body 102 to accommodate patients of varying body sizes. The VELCRO straps 112 are positioned to extend over the lower abdomen of the patient so that an upward lifting force is applied at the lower abdomen when the patient is suspended by the harness assembly 100. The side sections 106 are both tapered so that a lower portion 114 of each of the side sections 106 relatively tightly fits to the side and below the rib-cage of the patient as shown in FIG. 5B. On the other hand, an upper portion 116 of each of the side sections 106 relatively loosely fits to the side and over the rib-cage of the patient to provide sufficient support to the patient's upper body particularly in the lateral direction and yet to facilitate breathing of the patient. As a result of the tapered side sections 106, the harness assembly 100 will provide under-rib cage lift while allowing the patient to relatively easily breath when the patient is suspended by the harness assembly 100. The rear section 108 of the corset main body 102 is designed to generally fit to the lower back of the patient to provide support to the patient.

Figure 5C:
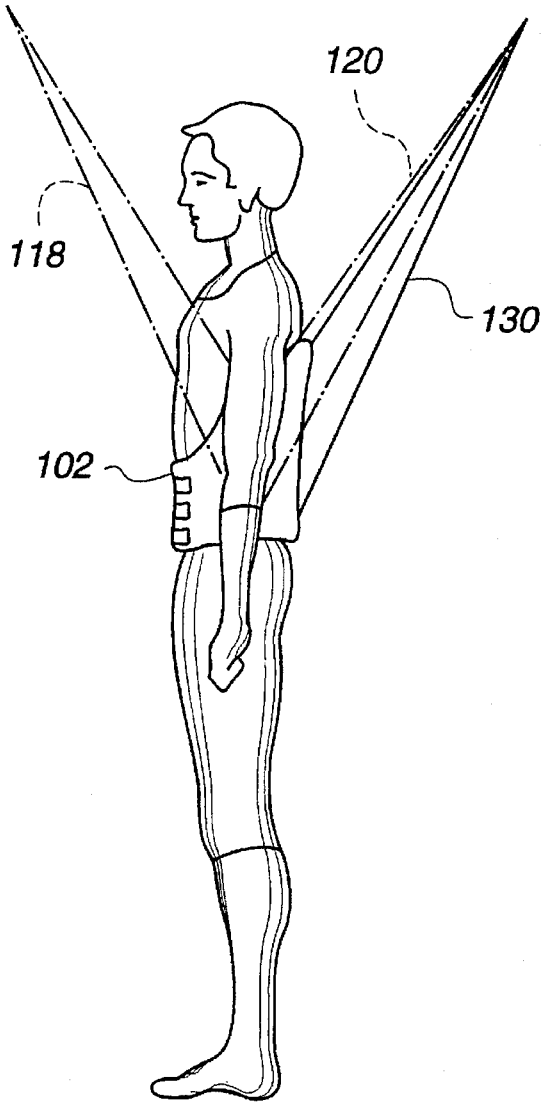
FIG. 5C is a side view of FIG. 5B.

The harness assembly 100 further includes a pair of front strap assemblies 118 and a pair of rear strap assemblies 120 connected to the corset main body 102. Each of the strap assemblies 118 and 120 may be formed by a plurality of band straps 122 having upper ends 124 and lower ends 126. The upper ends 124 of the band straps 122 are bound together and looped through a triangular metal connector 128 which may be connected to the lower end of a tension spring 129 in a similar manner described with reference to FIG. 4. The lower ends 126 of the band straps 122 are generally vertically funneled out and connected to each of the side sections 106. The length of each of the band straps 122 and locations of the lower ends 126 to be connected to the side section 106 should be determined so that the tension acting along the band straps 122 is substantially evenly distributed to each of the band straps 122. The corset main body 102 may be provided with a rear tension band strap assembly 130 which is connected to the rear section 108 thereof. As shown in FIG. 5A and FIG. 5C, the rear tension band strap assembly 130 is coupled to the overhead support assembly 20 and has lower ends being substantially laterally distributed and connected to the rear section of the corset main body 102. The pair of front strap assemblies 118, the pair of rear strap assemblies 120 and the rear tension band strap assembly 130 are generally symmetrically placed posteriorly and anteriorly to evenly distribute the lifting force vectors. In one embodiment, the pair of front strap assemblies 118 and the pair of rear strap assemblies 120 are downwardly and diagonally angled with respect to each other so that the corset main body 102 is suspended at the lower ends of the four strap assemblies which generally define four sides of an inverted pyramid configuration. Further, the rear tension band strap assembly 130 may be coupled to an additional truck and wheel assembly which is provided along the central longitudinal overhead frame member 44. It should be appreciated that more tension band strap assemblies may be used to further distribute the lifting force vectors.

In further embodiments, a front tension strap band assembly (not shown) may be connected to the front portion of the corset main body 102. In this case, the rear tension strap band assembly 130 and the front tension strap band assembly may be adjusted in their respective length to vary the amount of anterior or posterior pull to change the amount of lift anteriorly or posteriorly during inclination or declination of the treadmill, respectively.

Referring back to FIG. 2, the variable ambulation speed system 30 may be any one of the various commercially available motorized treadmills, such as the PRICORE system or IMAGE 935 system. The variable ambulation speed system 30 is capable of driving an endless belt 132 at varying speeds, for example from zero to twelve miles per hour, and changing the height of the front end of the belt 132, for example from minus ten (−10) to plus fifteen (+15) degrees. If the treadmill does not have capability of a declination, a block of suitable size, for example 4", can be placed at the rear end of the treadmill. The variable ambulation speed system 30 may be provided with a hand rail 134 to allow the patient to balance on the belt 132. The system 30 may also be provided with a step-off platform 136 to allow the patient to step off the belt 132 during the operation of the variable ambulation speed system 30. Both the handrail 134 and step-off platform 136 can be mounted on either side or bilaterally depending on space restrictions.

In operation, the length of the spacer bar assembly 66 should be appropriately adjusted by the length adjusting mechanism 67 to determine the angle of suspension between the front strap assembly 24 and the rear strap assembly 26. Also, the degree of suspension is measured by the tension scale 70 and adjusted if necessary by the cleated pulley assembly 68 or the traction unit 280 either previously to make it consistent with the design protocol or during the diagnostic or therapeutic operation to make it commensurate to the patient's response. It is found that the combination of the above described frame structure, harness assembly and speed system facilitate varying the angle of suspension, the amount of tension, and the degree of treadmill inclination or declination, which factors in turn affect the amount and specific type of decompression within the skeletal structural region and throughout the lower extremities being diagnosed or treated. It is also found that the use of the variable ambulation speed system 30 in combination with the harness assembly 22 will facilitate achieving uniform-symmetrical pull for maintaining and reeducating the body's neurological responses to movement and maximize healing response as well as rehabilitative and training responses.

Figure 6:
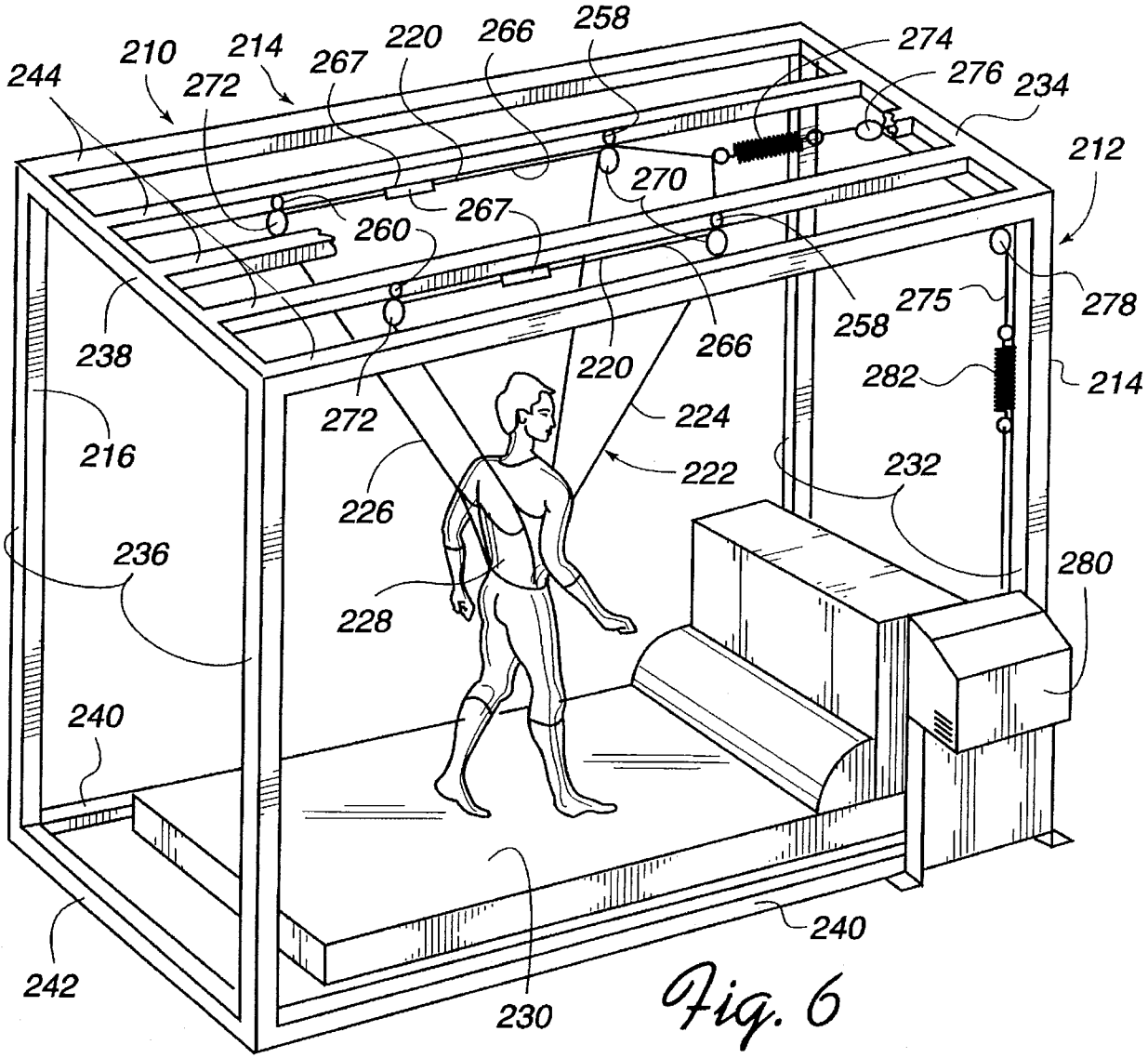
FIG. 6 is a partially broken perspective view illustrating an ambulatory traction unit in accordance with another preferred embodiment of the present invention and showing the manner in which a patient is suspended thereby in an upright walking position.

An ambulatory traction unit in accordance with another preferred embodiment of the present invention is indicated generally at 210 as illustrated in FIG. 6. The ambulatory traction unit 210 includes a frame structure 212. The frame structure 212 includes a horizontally extending overhead frame assembly 218 which is supported by a pair of front and rear vertical frame assemblies 214 and 216. Two overhead support assemblies 220 slidably engages the overhead frame assembly 218 for substantially linear horizontal displacement between the front and rear vertical frame assemblies 214 and 216. A harness assembly 222 includes two front straps 224 and two rear straps 226, both attached at respective upper ends thereof to the overhead support assembly 220. The lower ends of the front and rear straps 222 and 224 are connected to a harness main body 228 which is releasably attached to the body of the patient.

A variable ambulation speed system 230 is positioned below the harness assembly 222 to allow the patient to walk thereon while the patient is receiving treatments. The front straps 224 and the rear straps 226 are downwardly and diagonally angled with respect to each other so that the harness main body 228 is suspended at the lower ends of the four straps which generally define four sides of an inverted pyramid configuration.

The frame structure 212 may be made of any one of a variety of suitable materials, such as, aluminum, iron, reinforced glass-fiber, plastic or a combination thereof. In the illustrated embodiment, the front vertical frame assembly 214 of the frame structure 212 includes a pair of vertically extending frame members 232 and a laterally extending upper frame member 234 spanning between the vertical frame members 232 adjacent the top end portions thereof. The rear vertical frame assembly 216 also includes a pair of vertically extending frame members 236 and a laterally extending upper frame member 238 spanning between the vertical frame members 236. The vertical frame members 232 and 236 may be connected with each other at their respective lower end portions by two longitudinally extending lower frame members 240 and two laterally extending lower frame members 242.

The overhead frame assembly 218 of the frame structure 212 preferably includes five longitudinal overhead frame members 244 which extend generally in parallel with each other between the front vertical frame assembly 214 and the rear vertical frame assembly 216. Two of the longitudinal overhead frame members 244 are connected to the front and rear vertical frame assemblies 214 and 216 adjacent the vertical frame members 232 and 236. The middle three of the five longitudinal overhead frame members 244 may be connected to the intermediate portions of the laterally extending upper frame members 234 and 238.

Each of the overhead support assemblies 220 includes two front sliding elements 258 and two rear sliding elements 260, both of which are mounted respectively on the two spaced longitudinal overhead frame members 244. Each of the front and rear sliding elements 258 and 260 has a truck and wheel assembly similar to the one described above with reference to FIG. 4.

A spacer bar assembly 266 is provided between the front sliding elements 258 and the rear sliding elements 260 to maintain a predetermined separation therebetween. The spacer bar assembly 266 may preferably include a length adjusting mechanism 267 for changing the length of the spacer bar assembly 266 and therefore the separation between the front sliding elements 258 and the rear sliding elements 260.

In accordance with embodiments of the present invention, each of the space bar assembly 266 has a front pulley assembly 270 and a rear pulley assembly 272. Alternatively, the front pulley assembly 270 and the rear pulley assembly 272 may be connected to the overhead support assemblies 220. In one embodiment, the front pulley assembly 270 and the rear pulley assembly 272 may be connected to the two front sliding elements 258 and two rear sliding elements 260, respectively.

In the illustrated embodiment, the front straps 224 are carried by the associated front pulley assemblies 270 and the rear straps 226 are carried by the associated rear pulley assemblies 272. Four ends of the front and rear straps 224 and 226 are tied together at a cleat 273 in a manner that the length of each of the front straps and rear straps may be adjusted at the cleat 273. The cleat 273 is connected to a first tension spring 274 which in turn connects to a strap or a rope 275. The rope 275 is guided through a first guide pulley assembly 276 and a second guide pulley assembly 278 provided adjacent the upper frame member 234 and is connected to a traction unit 280. The traction unit 280 is used to control, measure and indicate the tension through the front and rear straps 224 and 226, and may be any one of appropriate off-the-shelf traction units, such as for example, an electromechanical traction unit with a built-in pneumatic tensiometer "TX-7" manufactured by CHATTANOOGA Corporation (Product No. 74121 Rev. B03/91). The rope 275 may include a second tension spring 282, preferably between the second guide pulley assembly 278 and the traction unit 280. The first tension spring 274 and the second tension spring 282 are adapted to maintain substantially constant tension along the strap assemblies.

The main harness body 228 (which is similar to the one described above with reference to FIG. 5) is connected to lower ends of the front straps 224 and the rear straps 226. In one aspect of the present invention, the front and rear sliding elements 258 and 260 are separated by the spacer bar assembly 266 to an extent that the upper ends of the front and rear straps 224 and 226 are separated from each other substantially greater than the longitudinal separation at the lower ends thereof which are connected to the harness main body 228. As a result, the front straps 224 and the rear straps 226 are downwardly and diagonally angled with each other so that the harness main body 228 is suspended between the front and rear straps 224 and 226 which generally define four sides of an inverted pyramid configuration.

It has been found that the harness assembly 222 described above further stabilizes the patient suspended thereby who is walking or running on the variable ambulation speed system 230. It has also been found that the harness assembly 222 decreases the inward compressional forces on the rib cage and diaphragm of the patient. As a result, the harness assembly 222 in combination with the harness main body 228 allow the patient to breath more easily and comfortably.

Figure 7:
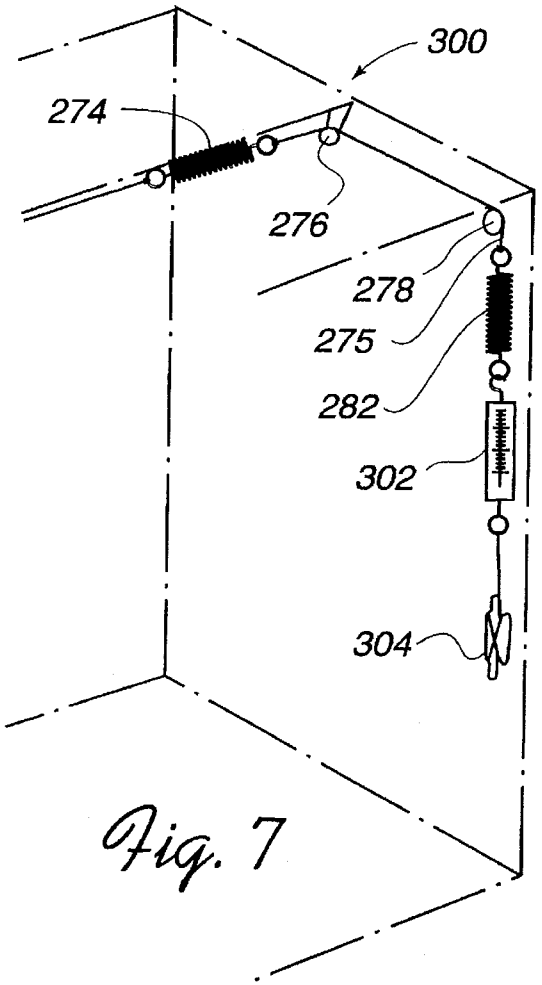
FIG. 7 is a schematical perspective view of an ambulatory traction unit in accordance with still another embodiment.

FIG. 7 shows another embodiment of a variable ambulation speed system 300. The variable ambulation speed system 300 has substantially the same structure and structural elements shown and described above with reference to FIG. 6. In place of the traction unit 280 described above, however, the variable ambulation speed system 300 has a tension scale 302 for measurement and indication of the tension along the strap assembly. The end of the rope 275 is tied to a hook 304.

In operation, the length of the spacer bar assembly 266 should be appropriately adjusted by the length adjusting mechanism 267 to determine the angle of suspension between the front straps 224 and the rear straps 226. Also, the degree of suspension is measured by the tension unit 280 or the scale 302 and adjusted if necessary.

In accordance with embodiments of the present invention, the harness assembly 222 may be used, depending upon the patients' or users' particular requirements, in combination with exercise apparatuses other than the variable ambulation speed system 230, such as for example, a stationary bicycle apparatus, a cross-country skiing apparatus, a vertical climbing apparatus, a portable stairs.

While the invention has been described with respect to the illustrated embodiments in accordance therewith, it will be apparent to those skilled in the art that various modifications and improvements may be made without departing from the scope and spirit of the invention. For example, the two upper ends of the pair of front strap assemblies 24 and the two upper ends of the pair of rear strap assemblies 26 as shown in FIGS. 1 and 2 may be suspended from a single front sliding element and a single rear sliding element, respectively. Moreover, the two overhead support assemblies 220 as shown in FIG. 6 may be coupled to each other so that the two overhead support assemblies 220 move together along the overhead support frames 244. Also, each of the front and rear sliding elements 258 and 260 may be fixed or locked to the overhead support frames 244 so that the overhead support assemblies 220 do not move from a predetermined position. Other embodiments are also possible, their specific designs depending upon the particular application. As such, the scope of the invention should not be limited by the particular embodiments herein described but should be defined only by the appended claims and equivalents thereof.

What is claimed is:

1. A traction system for supporting a patient comprising:

a frame structure including a horizontal beam member;

an overhead support slidably engaging said horizontal beam member for horizontal linear displacement in parallel with said horizontal beam member, said overhead support having a front end portion and a rear end portion:

a patient harness assembly suspended from the overhead support, said harness assembly including a front strap assembly coupled to said front end portion and a rear strap assembly coupled to said rear end portion, wherein said front strap assembly and said rear strap assembly are diagonally angled with each other to generally define two sides of an inverted triangle; and an angle adjusting assembly placed between said front end portion and said rear end portion, said angle adjusting assembly having means for changing the separation between said front end portion and said rear end portion to thereby change the angle defined between said front strap assembly and said rear strap assembly.

2. A traction system as defined in claim 1, wherein said harness assembly includes a corset, said corset having tapered sides so as to provide under-rib cage lift.

3. A traction system as defined in claim 1, wherein said harness assembly includes a corset being shaped to generally surround the upper torso of the patient, said corset having a front section, side sections and a rear section, said front section defining a generally U-shaped opening to substantially avoid contact to the front portion of the rib cage of the patient and having reclosable straps below said U-shaped opening for reclosably fastening said corset about the upper torso of the patient, said side sections being tapered and having upper portions and lower portions narrower than said upper portions to engage the sides under the rib cage of the patient to provide under-rib cage lift when the patient is suspended by said harness assembly.

4. A traction system as defined in claim 3, wherein said front strap assembly includes a pair of first and second straps and said rear strap assembly includes a pair of third and fourth straps, said first strap and said third strap being connected to one of said side sections of said corset, said second strap and said fourth strap being connected to the other of said side sections of said corset.

5. A traction system as defined in claim 3, wherein said front strap assembly includes a first group and a second group of straps and said rear strap assembly includes a third group and a fourth group of straps, said first and third group of straps having end portions being substantially laterally distributed and connected to one of said side sections of said corset, said second and fourth group of straps having end portions being substantially laterally distributed and connected to the other of said side sections of said corset so that a lifting force is substantially evenly distributed along said straps.

6. A traction system as defined in claim 5, wherein said harness assembly includes a rear tension strap assembly being connected to said overhead support means and having lower ends being substantially laterally distributed and connected to said rear section of said corset.

7. A traction system as defined in claim 1, wherein each of said front strap assembly and said rear strap assembly has a tension measuring device.

8. A traction system as defined in claim 1, wherein each of said front strap assembly and said rear strap assembly has a tension spring.

9. A traction system as defined in claim 1, wherein each of said front strap assembly and said rear strap assembly has a length adjustment device for adjusting the length of each of said front strap assembly and said rear strap assembly.

10. A traction system as defined in claim 1 further comprising a variable speed/inclination/declination treadmill, the treadmill including means for changing at least one of speed, inclination and declination thereof and positioned below said overhead support means to allow the patient to use said treadmill while being suspended by said harness assembly.

11. A traction system for use in assisting a patient comprising:

a frame structure having a front section and a rear section, said frame structure including at least one overhead horizontal beam longitudinally extending between the front section and the rear section of said frame;

support means slidably engaging said horizontal beam for horizontal linear displacement along said horizontal beam, said support means having a front coupling device and a rear coupling device spaced a distance from said front coupling device along said horizontal beam;

a harness assembly suspended from said support means, said harness assembly including a main body for releasable attachment to the body of the patient, a front strap assembly being connected to said main body at one end thereof and to said front coupling device at the other end thereof and a rear strap assembly connected to said main body at one end thereof and to said rear coupling device at the other end thereof, wherein said front strap assembly and said rear strap assembly are diagonally and downwardly angled with each other to generally define two sides of an inverted triangle; and an angle adjusting assembly having means for changing the separation between said front coupling device and said rear coupling device to thereby change an angle defined between said front strap assembly and said rear strap assembly.

12. A traction system for use in assisting a patient comprising:

a frame structure having a front section and a rear section, said frame structure including at least one overhead horizontal beam longitudinally extending between the front section and the rear section of said frame, said at least one overhead horizontal beam having a guide track, support means slidably engaging said horizontal beam for horizontal linear displacement along said horizontal beam, said support means having a front coupling device and a rear coupling device spaced a distance from said front coupling device along said horizontal beam, said support means further having a front wheeled sliding assembly connected to said front coupling device and being guided along said guide track and a rear wheeled sliding assembly connected to said rear coupling device and being guided along said guide track; wherein said support means includes a variable length rigid bar assembly disposed between said front wheeled sliding assembly and said rear wheeled sliding assembly, said bar assembly having means for changing the separation between said front coupling device and said rear coupling device to thereby change an angle defined between said front strap assembly and said rear strap assembly; and a harness assembly suspended from said support means, said harness assembly including a main body for releasable attachment to the body of the patient, a front strap assembly being connected to said main body at one end thereof and to said front coupling device at the other end thereof and a rear strap assembly connected to said main body at one end thereof and to said rear coupling device at the other end thereof, wherein said front strap assembly and said rear strap assembly are diagonally and downwardly angled with each other to generally define two sides of an inverted triangle.

13. A traction system for use in assisting a patient comprising:

a frame having a front section and a rear section, said frame including at least two overhead horizontal beams longitudinally extending in parallel with each other between the front section and the rear section of said frame;

a front wheeled sliding assembly slidably engaging said two over head horizontal beams for horizontal linear displacement along said horizontal beams, said front wheeled sliding assembly having a pair of laterally spaced front coupling devices;

a rear wheeled sliding assembly longitudinally spaced from said front wheeled sliding assembly and slidably engaging said two over head horizontal beams for horizontal linear displacement along said horizontal beams, said rear wheeled sliding assembly having a pair of laterally spaced rear coupling devices;

a harness assembly suspended from said front and rear wheeled sliding assemblies, said harness assembly including a main body for releasable attachment to the body of the patient, a pair of front straps respectively connected to said pair of front coupling devices and a pair of rear straps respectively connected to said pair of rear coupling devices, wherein said pair of front straps and said rear straps diagonally angled with each other to define four sides of an inverted quadrangular pyramid and connect to said main body;

a variable length rigid bar means connecting said front wheeled sliding assembly and said rear wheeled sliding assembly, said bar means having means for longitudinally adjusting the separation between said front wheeled sliding assembly end said rear wheeled sliding assembly to thereby adjust the angle between said pair of front straps and said pair of rear straps;

a length adjustment device provided in each of said straps for adjusting the length of each of said straps; and a treadmill including means for changing at least one of speed, inclination and declination thereof, said treadmill being positioned below said harness assembly to allow the patient to use said treadmill while being suspended by said harness assembly.

14. A traction system for supporting a patient comprising:

a frame structure including a horizontal beam member;

an overhead support slidably engaging said horizontal beam member for horizontal linear displacement in parallel with said horizontal beam member, said overhead support having a front end pulley assembly and a rear end pulley assembly; and a patient harness assembly, said patient harness assembly having a front strap assembly carried by said front end pulley assembly and a rear strap assembly carried by said rear end pulley assembly, wherein said front strap assembly and said rear strap assembly are angled with respect to each other;

an angle adjusting assembly placed between said front end pulley assembly and said rear end pulley assembly, said angle adjusting assembly having means for changing the separation between said front end pulley assembly and said rear end pulley assembly to thereby change the angle defined between said front strap assembly and said rear strap assembly.

15. A traction system as defined in claim 14, wherein said front strap assembly and said rear strap assembly are diagonally angled with each other to generally define two sides of an inverted triangle.

16. A traction system as defined in claim 14 further comprising a traction unit for providing a controlled tension through said front strap assembly and said rear strap assembly.

17. A traction system as defined in claim 14, wherein said harness assembly includes a corset, said corset having tapered sides so as to provide under-rib cage lift.

18. A traction system for supporting a patient comprising:

a frame structure including a horizontal beam member;

an overhead support slidably engaging said horizontal beam member for horizontal linear displacement in parallel with said horizontal beam member, said overhead support having a front end pulley assembly and a rear end pulley assembly; and a patient harness assembly, said patient harness assembly having a front strap assembly carried by said front end pulley assembly and a rear strap assembly carried by said rear end pulley assembly, wherein said harness assembly includes a corset being shaped to generally surround the upper torso of the patient, said corset having a front section, side sections and a rear section, said front section defining a generally U-shaped opening to substantially avoid contact to the front portion of the rib cage of the patient and having reclosable straps below said U-shaped opening for reclosably fastening said corset about the upper torso of the patient, said side sections being tapered and having upper portions and lower portions narrower than upper portions to engage the sides under the rib cage of the patient to provide under-rib cage lift when the patient is suspended by said harness assembly;

wherein said front strap assembly includes a pair of first and second straps and said rear strap assembly includes a pair of third and fourth straps the first, second, third and fourth straps having lower ends and upper ends, the lower ends of said first strap and said third strap being connected to one of said side sections of said corset, the lower ends of said second strap and said fourth strap being connected to the other of said side sections of said corset; wherein said overhead support comprises two spaced over head support assemblies, each of said over head support assemblies having a front end pulley and a rear end pulley, each of said first and second straps being carried by one of said front end pulleys, each of said third and fourth straps being carded by one of said rear end pulleys, and wherein the upper ends of the first, second, third and fourth straps are placed upstream of the associated front and rear end pulleys and combined together.

19. A traction system as defined in claim 18 further comprising a traction unit for providing a controlled tension through the front strap assembly and said rear strap assembly, and wherein said combined upper ends of the first, second, third and fourth straps are connected to a fifth strap, said fifth strap being connected to said traction unit.

20. A traction system as defined in claim 19 further comprising guide means for guiding the fifth strap to the traction unit.

* * * * *